US006784609B2

(12) United States Patent
Speer et al.

(10) Patent No.: US 6,784,609 B2
(45) **Date of Patent: *Aug. 31, 2004**

(54) FLUORESCENT LAMP AND AMALGAM ASSEMBLY THEREFOR

(75) Inventors: Richard S. Speer, Concord, MA (US); Louise D. Cleary, Salem, MA (US)

(73) Assignee: Osram Sylvania Inc., Danvers, MA (US)

( * ) Notice: Subject to any disclaimer, the term of this patent is extended or adjusted under 35 U.S.C. 154(b) by 52 days.

This patent is subject to a terminal disclaimer.

(21) Appl. No.: 10/230,621

(22) Filed: Aug. 29, 2002

(65) Prior Publication Data

US 2004/0041515 A1 Mar. 4, 2004

(51) Int. Cl.[7] ..... H01J 1/62; H01J 63/04
(52) U.S. Cl. ..... 313/490; 313/483; 313/493
(58) Field of Search ..... 313/160–161, 313/153, 545, 490–493, 564–566, 635, 550, 607, 594; 427/66–67; 315/267, 248

(56) References Cited

U.S. PATENT DOCUMENTS

| | | | | |
|---|---|---|---|---|
| 4,035,682 A | | 7/1977 | Bubar | 313/174 |
| 4,393,325 A | | 7/1983 | van der Kooi | 313/552 |
| 4,528,209 A | | 7/1985 | Anderson et al. | 427/67 |
| 5,434,482 A | | 7/1995 | Borowiec et al. | 315/248 |
| 5,629,584 A | | 5/1997 | Borowiec et al. | 315/565 |
| 5,767,617 A | | 6/1998 | Wharmby et al. | 313/489 |
| 5,994,837 A | | 11/1999 | Willems et al. | 313/550 |
| 6,097,137 A | | 8/2000 | Forsdyke et al. | 313/161 |
| 6,650,041 B1 | * | 11/2003 | Speer et al. | 313/490 |
| 6,653,775 B1 | * | 11/2003 | Speer et al. | 313/490 |

* cited by examiner

*Primary Examiner*—Vip Patel
*Assistant Examiner*—Anthony Perry
(74) *Attorney, Agent, or Firm*—Carlo S. Bessone

(57) ABSTRACT

An amalgam assembly for a fluorescent lamp includes a glass exhaust tubulation extending from an envelope portion of the lamp toward a base portion of the lamp, the tubulation being closed at an end adjacent the lamp base portion, and a glass body disposed in the tubulation and retained by a pinched portion of the tubulation, the glass body being disposed between the pinched portion and the closed end of the tubulation. A mercury amalgam body is disposed between the glass body and the closed end of the tubulation. A mercury wetting metallic layer is disposed on a selected one of (i) an inside surface of the tubulation between the pinched portion and the closed end of the tubulation, and (ii) a surface of the glass body whereby to a wet at least one of (i) the interior surface of the glass tubulation and (ii) the surface of the glass body, to prevent the amalgam, when liquidized, from flowing past the tubulation pinched portion and into the lamp envelope.

14 Claims, 2 Drawing Sheets

FLUORESCENT LAMP AND AMALGAM ASSEMBLY THEREFOR

BACKGROUND OF THE INVENTION

1. Field of the Invention

This invention relates to fluorescent lamps and is directed more particularly to an amalgam assembly for use within a fluorescent lamp, and to a lamp having such amalgam assembly disposed therein.

2. Description of the Prior Art

The light output of fluorescent lamps is critically dependent upon mercury vapor pressure (vapor density) within the lamp envelope. The mercury vapor pressure, in turn, is controlled by the temperature of excess liquid mercury which condenses in the coldest part of the lamp envelope, the so-called "cold spot". Fluorescent lamps typically include at least one tubulation that has an opening into the interior of the lamp envelope and which, in construction of the lamp, is used as an exhaust and fill tubulation. At completion of manufacture, the exhaust tubulation is hermetically tipped off and the tipped end typically becomes the lamp "cold spot".

The amalgam is commonly located in the exhaust tubulation cold spot. Such amalgams reduce the mercury vapor pressure relative to that of pure mercury at any given temperature and thereby permit optimum light output at elevated temperatures. Such amalgams also provide a broadened peak in the light output versus temperature curve, so that near optimum light output is obtained over an extended range of ambient temperatures.

When lamps are operated at temperatures lower or higher than the optimum ambient temperature, light output decreases by as much as 30% or more relative to peak value. This is a common occurrence when lamps are operated in enclosed or semi-enclosed fixtures. In addition to reduced light output, the color of the light varies as a result of the varying contribution of blue spectral emission from the mercury vapor in the discharge.

The problem of mercury vapor pressure control under varying temperature conditions is solved, at least in part, through the use of various alloys capable of absorbing mercury from its gaseous phase. Alloys of low temperature melting metals are often placed within fluorescent lamps to amalgamate with the excess mercury, and to regulate the mercury vapor pressure within the lamp. Alloys known to be particularly useful in forming amalgams with mercury include a lead-bismuth-tin alloy, a bismuth-indium alloy, a bismuth and tin alloy, and a zinc, indium and tin alloy. Other useful amalgams may be formed with pure indium, pure lead, and pure zinc.

The lamp typically is provided with an excess amount of mercury amalgam, that is, more amalgam than is needed to supply the mercury vaporized when the lamp reaches a stabilized operating condition. As the lamp ages, some of the excess amalgam is required to replace the mercury chemically bound elsewhere in the lamp during the life of the lamp.

When an amalgam fluorescent lamp is turned off, the amalgam cools and the mercury vapor within the lamp is gradually absorbed into the amalgam. When the lamp is turned on, the lumen output is significantly reduced until the amalgam is warmed up to a point at which the amalgam emits sufficient mercury vapor to permit efficient lamp operation.

In some types of lamps, particularly electrodeless fluorescent lamps, it is important that the amalgam be prevented from settling within the arc environment in the lamp envelope where the amalgam can cause deleterious changes in the lumen output and the lumen-temperature performance of the lamp.

In base-up lamps, there has been a particular problem in that, in use, the sealed end of the tubulation is pointed upwardly and the end of the tubulation that opens into the lamp envelope is disposed downwardly of the amalgam. The amalgam has tended to drop by gravity downwardly into the lamp envelope, where a much higher temperature is present, causing a sudden rise in mercury vapor pressure and an increase in lamp voltage, resulting in the occurrence of black spots on the glass envelope. If the lamp voltage exceeds the maximum sustaining voltage of the ballast provided in the lamp, the lamp extinguishes. There is thus required a means for retaining liquid amalgam in the tubulation, but permitting mercury vapor to exit the tubulation and flow into the lamp envelope.

Accordingly, there is a need for an amalgam assembly including an amalgam retaining means for limiting the amalgam to the tubulation sealed end region, and for a fluorescent lamp provided with such an amalgam assembly.

SUMMARY OF THE INVENTION

An object of the invention is, therefore, to provide an amalgam assembly for disposition in an exhaust tubulation of a fluorescent lamp to prevent migration of liquid amalgam into the lamp envelope.

A further object of the invention is to provide an electrodeless fluorescent lamp having therein an improved amalgam assembly which prevents the aforesaid migration of liquid amalgam.

With the above and other objects in view, a feature of the present invention is the provision of an amalgam assembly for a fluorescent lamp. The assembly comprises a glass exhaust tubulation extending toward a base portion of the lamp, the tubulation being closed at an end adjacent the base portion, and a glass body disposed in the tubulation and retained by a pinched portion of the tubulation, the glass body being disposed between the pinched portion of the tubulation and the closed end of the tubulation. A mercury amalgam body is disposed between the glass body and the closed end of the tubulation. A mercury wetting metallic layer is disposed on at least one of (i) an inside surface of the tubulation between the pinched portion and the closed end of the tubulation, and (ii) a surface of the glass body, whereby to wet a selected one of (i) the interior surface of the glass tubulation and (ii) the surface of the glass body, respectively, to prevent the amalgam from flowing past the tubulation pinched portion and into the lamp envelope.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENT

Figure 1:
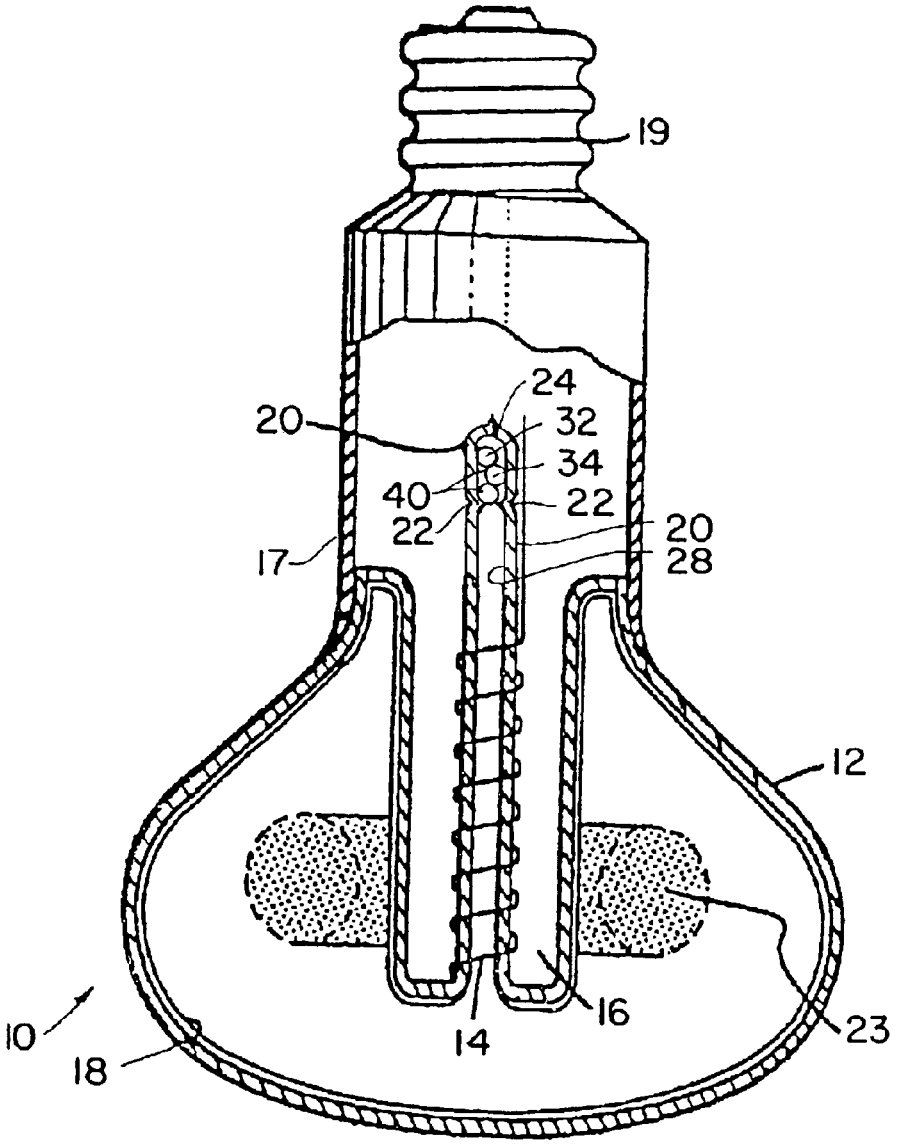
FIG. 1 PRIOR ART
FIG. 1 is an elevational broken-away and partly sectional view of a prior art electrodeless fluorescent lamp.

Referring to FIG. 1, it will be seen that a known base-up compact fluorescent lamp 10 is provided with a light-transmissive envelope 12 containing an ionizable gaseous fill for sustaining an arc discharge. In manufacture, the lamp 10 is dosed with the fill via an exhaust tubulation 20 in well-known manner. A suitable fill, for example, comprises a mixture of a rare gas (e.g., krypton and/or argon) and mercury vapor. An excitation coil 14 is situated within, and removable from, a re-entrant cavity 16 within the envelope 12. For purposes of illustration, the coil 14 is shown schematically as being wound about the exhaust tubulation 20. However, the coil 14 may be spaced apart from the exhaust tubulation 20 and wound about a core of insulating material (not shown), or may be free standing (not shown), as desired. The interior surfaces of the envelope 12 are coated in well-known manner with a suitable phosphor 18. The envelope 12 fits into one end of a base assembly 17 containing a radio frequency power supply (not shown) with a standard (e.g., Edison type) lamp base 19.

A mercury amalgam body 32 is placed and retained in a location optimized for the particular amalgam in a particular lamp. Each amalgam has its own optimum range of operating temperatures to provide a suitable mercury vapor pressure.

Referring to FIG. 1, it will be seen that there is provided an amalgam retainer, preferably comprising one or more glass balls 40 disposed in the glass tubulation 20 and retained by at least one pinched portion 22 of the tubulation.

The mercury amalgam body 32 is disposed between the glass balls 40 and an exhaust tubulation closed end 24, as shown in FIG. 1. The amalgam body 32 is generally spherically shaped when in a solid state.

The tubulation pinched portion 22 is situated toward the closed end region 24 of the exhaust tubulation 20. The closed end region is the area at the top of the exhaust tubulation 20 which is sealed, or "tipped off" to form the tip of the exhaust tubulation after evacuating and filling the lamp therethrough.

After the lamp is evacuated and filled through exhaust tubulation 20, an appropriately sized glass ball 40, or a plurality of glass balls 40, are inserted into the exhaust tubulation 20 through an opening at the tip-off region. By virtue of the presence of the tubulation pinched portion 22 and the size and shape of the glass balls 40, the glass balls remain on the side of the pinched portion away from the re-entrant cavity 16. The amalgam body 32 is then inserted into the exhaust tubulation 20 through the opening in the tip-off region. The combination of pinched portion 22 and glass balls 40 results in placement and retention of the amalgam body 32 at a predetermined location. Finally, the exhaust tubulation is tipped-off at a location just above the amalgam body 32.

In operation, current flows in the coil 14 as a result of excitation by the radio frequency power supply. A radio frequency magnetic field is thereby established within the envelope 12 which ionizes and excites the gaseous fill contained therein, resulting in a toroidal discharge 23 and emission of ultraviolet radiation therefrom. The phosphor 18 absorbs the ultraviolet radiation and emits visible radiation.

It has been found that the while the combination of tubulation pinched portion 22 and glass balls 40 serves to retain the amalgam at the closed end of the tubulation most of the time, there are occasions when the liquid amalgam finds its way around the glass balls and into the lamp envelope, causing malfunction and/or failure of the lamp.

Figure 2:
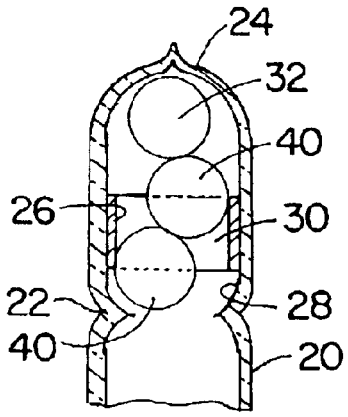
FIG. 2 is a diagrammatic illustration of an improved amalgam assembly for preventing movement of liquid amalgam in a lamp of the type shown in FIG. 1 from the preferred amalgam location.

In accordance with the invention, a layer 26 of a metallic mercury wetting agent is disposed on an inside surface 28 of the tubulation 20 in an area between the pinched portion 22 and the closed end 24 of the tubulation. The wetting agent layer 26 may be of indium or silver or gold, or alloys having at least one of such metals as a component thereof. The wetting agent layer 26 may be disposed in a band 30, as shown in FIG. 2.

Figure 3:
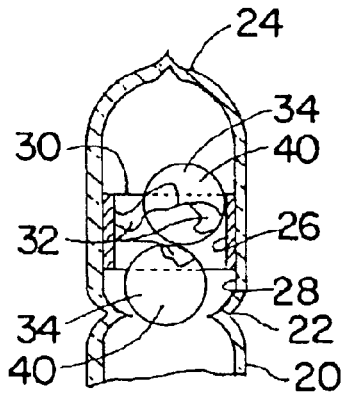
FIG. 3 is similar to FIG. 2, but illustrative of the amalgam of FIG. 2 after liquidizing thereof.

When the amalgam body 32 in a base-up lamp is liquidized, the liquid amalgam tends to flow downwardly and, on occasion flows around the glass body or bodies 40 and into the lamp envelope 12. However, with the wetting agent band 30 in place, the liquid amalgam is attracted to, and adheres to, the band 30 (FIG. 3) and is thereby prevented from moving further towards the lamp envelope 12.

Figure 4:
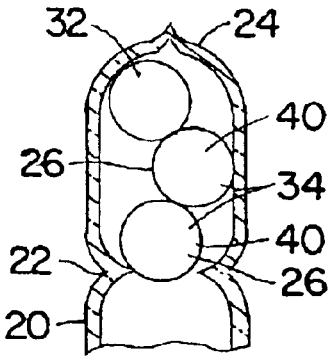
FIG. 4 is similar to FIG. 2, but illustrative of an alternative embodiment of amalgam assembly.
Figure 5:
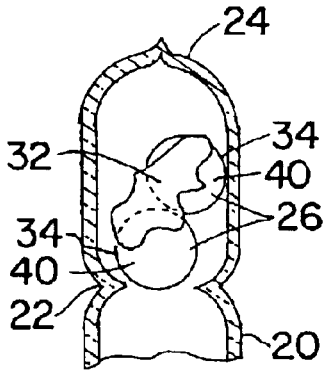
FIG. 5 is similar to FIG. 4, but illustrative of the amalgam of FIG. 4 after liquidizing thereof.

Referring to FIG. 4, it will be seen that in an alternative embodiment the metallic mercury wetting agent is disposed on the surface 34 of the glass body or bodies 40 disposed in the tubulation 20. When the amalgam liquidizies, it is attracted to the glass bodies 40 and attaches thereto (FIG. 5), rather than flowing around the glass bodies and toward the lamp envelope.

It will be understood that many additional changes in the details, materials, and arrangement of parts, which have been herein described and illustrated in order to explain the nature of the invention, may be made by those skilled in the art within the principles and scope of the invention as expressed in the appended claims.

What is claimed is:

1. An amalgam assembly for a fluorescent lamp, the assembly comprising:

a glass exhaust tubulation extending from an envelope portion of the lamp toward a base portion of the lamp, said tubulation being closed at an end adjacent the base portion;

a glass body disposed in said tubulation and retained by a pinched portion of said tubulation, said glass body being disposed between the pinched portion of said tubulation and the closed end of said tubulation;

a mercury amalgam body disposed between the glass body and the closed end of said tubulation; and a mercury wetting metallic layer disposed on a surface of said glass body;

whereby to wet at least the surface of said glass body, to prevent liquid amalgam from flowing past the tubulation pinched portion and into the lamp envelope.

2. The amalgam assembly in accordance with claim 1 wherein said mercury wetting metallic layer is of a selected one of silver, gold, and indium, and alloys thereof, respectively.

3. The amalgam assembly in accordance with claim 1 wherein said amalgam body is generally spheroid in configuration prior to liquidizing thereof.

4. The amalgam assembly in accordance with claim 3 wherein said glass body is of a spheroid configuration.

5. The amalgam assembly in accordance with claim 4 and further comprising a second glass spheroid disposed between the pinched portion of said tubulation and said amalgam body, said second glass spheroid obstructing movement of said amalgam body in the tubulation past the second glass spheroid when said amalgam body is in a solid state.

6. The amalgam assembly in accordance with claim 1 wherein said mercury wetting metallic layer is further disposed on an inside surface of said tubulation and upon liquidizing of said amalgam body the liquid amalgam adheres to the inside surface of said tubulation in an area of said metallic layer.

7. The amalgam assembly in accordance with claim 1 wherein said mercury wetting metallic layer is disposed on the surface of the glass body and upon liquidizing of said amalgam body the liquid amalgam adheres to the surface of the glass body.

8. An electrodeless fluorescent lamp assembly, comprising:

a light-transmissive envelope containing an ionizable, gaseous fill for sustaining an arc discharge when subjected to a radio frequency magnetic field and for emitting ultraviolet radiation as a result thereof, said envelope having an interior phosphor coating for emitting visible radiation when excited by the ultraviolet radiation, said envelope having a re-entrant cavity formed therein;

an excitation coil contained within the re-entrant cavity for providing the radio frequency magnetic field when excited by a radio frequency power supply;

an exhaust tubulation extending through the re-entrant cavity and into said envelope, said exhaust tubulation having a closed end proximate a base portion of the lamp;

a pinched portion formed in said exhaust tubulation at a selected distance from said closed end;

a mercury amalgam body disposed in said exhaust tubulation between the exhaust tubulation closed end and said pinched portion of said exhaust tubulation;

a glass body disposed in said exhaust tubulation and retained by said pinched portion, said glass body being disposed between said pinched portion of said tubulation and said amalgam body; and a coating of a metal wetting agent disposed on a surface of said glass body;

whereby to wet at least the surface of said glass body, to prevent said amalgam from flowing past the tubulation pinched portion into the lamp envelope.

9. The lamp assembly in accordance with claim 8 wherein said mercury wetting metallic layer is of a selected one of silver, gold, and indium, and alloys thereof, respectively.

10. The lamp in accordance with claim 8 wherein said amalgam body is generally spheroid in configuration prior to liquidizing thereof.

11. The lamp assembly in accordance with claim 10 wherein said glass body is of a spheroid configuration.

12. The lamp assembly in accordance with claim 11 and further comprising a second glass spheroid disposed between said pinched portion of said tubulation and said amalgam body, said second glass spheroid obstructing movement of said amalgam body in said tubulation past the tubulation pinched portion when said amalgam is in a solid state.

13. The lamp assembly in accordance with claim 8 wherein said mercury wetting metallic layer is further disposed on an inside surface of said tubulation and upon liquidizing of said amalgam body the liquid amalgam adheres to the inside surface of said tubulation in an area of said metallic layer.

14. The lamp assembly in accordance with claim 8 wherein said mercury wetting metallic layer is disposed on the surface of the glass body and upon liquidizing of said amalgam body the liquid amalgam adheres to the surface of the glass body.

* * * * *